US007219705B2

(12) United States Patent
Wallek

(10) Patent No.: US 7,219,705 B2
(45) Date of Patent: May 22, 2007

(54) LEAF BAG SYSTEM FOR USE WITH RECEPTACLES

(76) Inventor: Tim Wallek, 19635 Hillside St., Deephaven, MN (US) 55331

( * ) Notice: Subject to any disclaimer, the term of this patent is extended or adjusted under 35 U.S.C. 154(b) by 6 days.

(21) Appl. No.: 11/258,965

(22) Filed: Oct. 26, 2005

(65) Prior Publication Data

US 2007/0089803 A1 Apr. 26, 2007

(51) Int. Cl.
*B65B 39/00* (2006.01)

(52) U.S. Cl. ..... 141/340; 141/337

(58) Field of Classification Search ..... 141/114, 141/314–316, 337, 340, 390; 294/1.1, 55; 248/97–99

See application file for complete search history.

(56) References Cited

U.S. PATENT DOCUMENTS 3,936,087 A * 2/1976 Alexander ..... 294/1.1
3,983,914 A * 10/1976 Benson ..... 141/390
4,312,531 A * 1/1982 Cross ..... 294/55
4,749,011 A 6/1988 Rylander ..... 141/316
5,056,679 A 10/1991 Lonczak ..... 141/390
5,121,779 A 6/1992 Green ..... 141/337
5,271,589 A * 12/1993 Belous ..... 248/97
5,570,862 A 11/1996 Nugent ..... 248/97
5,588,622 A 12/1996 Gordon ..... 248/101
5,716,033 A 2/1998 Gibson ..... 248/95
5,915,768 A * 6/1999 Young ..... 294/1.1
6,135,518 A 10/2000 Holthaus ..... 294/1.1
6,938,860 B2 * 9/2005 Singleton ..... 248/99

* cited by examiner

*Primary Examiner*—Timothy L. Maust
(74) *Attorney, Agent, or Firm*—Mark A. Litman & Associates, P.A.

(57) ABSTRACT

A system provides a shaped access path to a bag within a receptacle or can. The system comprises a funnel-providing system of a neck portion and a funnel portion. The funnel-providing portion comprises a flexible material that forms a leading edge of the funnel portion that curves back onto itself to form a funnel having a wide leading edge and a narrower base of the funnel portion. The narrower base of the funnel portion is connected to the neck portion. A gripping element extends over at least a length of the neck portion, the gripping portion capable of gripping an element (such as the end of a plastic bag) placed between the gripping element and the neck portion.

20 Claims, 2 Drawing Sheets

LEAF BAG SYSTEM FOR USE WITH RECEPTACLES

BACKGROUND OF THE INVENTION

1. Field of the Invention

The present invention generally relates to refuse receptacle devices, and to a funnel device for holding leaf/refuse bags to a receptacle, box or can and facilitating the raking or sweeping of leaves and other refuse into a bag within the can.

2. Background of the Art

Leaf bags or trash bags are well known and commonly used for the collection and disposal of leaves and other types of refuse from lawns and other generally flat areas from which leaves are raked or swept and placed in bags. To reduce their cost and bulk, such leaf or trash bags are typically made of thin plastic material with sufficient tensile strength to hold low density materials such as leaves or paper. These bags will not stand alone when empty and must be supported in some manner for filling. Although bags can be held open by hand, this approach is very inefficient and can be very frustrating when a single person is attempting to fill bags. It is even more desirable to be able to rake or sweep leaves and other refuse into a bag with the bag lying flat, and it is almost impossible for a single person to hold a bag open by hand while raking or sweeping refuse into it.

Various approaches have been attempted in an effort to address the problem of supporting a bag in an open position for filling, with varying degrees of success. Placing a bag inside an existing trash can or box will provide some support for the bag and allow it to be filled from the top. This approach does not readily accommodate raking or sweeping refuse into the bag. The weight of leaves in the bag will often pull the bag from its support around the lip of the can, such as a twenty-gallon or thirty-gallon garbage can.

A number of devices have been devised for the specific purpose of holding or supporting a leaf or trash bag while it is filled, but all such devices known in the prior art have disadvantages or drawbacks. One such device comprises a rigid structure with a pair of centrally pivoting legs, designed to fold flat for storage and to support a bag suspended between the legs when open. The only means of adjustment for bags of differing sizes is the degree to which the legs are pivoted open, which can result in excessive force against the top of the bag and tearing of the bag. This device is useable only in an upright position, and does not securely hold the bag in place to prevent slipping. In addition, a filled bag can be difficult to remove from between the legs of the device without tearing the bag.

Another device is formed as a flexible, shape retentive plastic sheet that can be rolled into a cylinder and placed inside a bag. When the rolled sheet is released it partially unrolls until constrained by the bag, so that the force of the sheet against the inside of the bag holds it in an open, generally cylindrical form. When the bag is filled, the sheet is slipped from the open end of the bag. Although a bag opened with this device can be placed on its side for filling, only a small area is in contact with the ground because of the cylindrical form, and raking or sweeping material into the bag is difficult. Use of this device can be cumbersome for a single person because it is necessary to hold the rolled sheet to prevent it from unrolling while, at the same time, holding the bag open and inserting the rolled sheet into the bag. This device will accommodate different sized bags, although the force holding and supporting the bag will vary and the bag may slip along the sheet and become disengaged during handling and filling. Examples of such flexible supports are found in U.S. Pat. No. 5,716,033 (Gibson); U.S. Pat. No. 5,056,679 (Lonczak); and U.S. Pat. No. 4,749,011 (Rylander).

Yet another device includes a body with a funnel-like opening with a large throat to which a bag can be attached. Various of these embodiments are shown in U.S. Pat. No. 6,938,860 (Singleton); U.S. Pat. No. 5,121,779 (Green); and U.S. Pat. No. 6,135,518 (Holthaus). In one of these embodiments, the body of the structure is supported by legs so that the bag can be hung from the body, secured by clips, between the legs or with the legs in the interior of the bag. The bag is then filled from the top. In some variations the bag and support structure may be placed on the ground, either with or without the legs, so that leaves, etc. can be raked or swept into the bag, but the design of the body does not facilitate use in a horizontal orientation and it can be difficult to push leaves, etc. through the opening to fully fill the bag. These structures are of rigid construction with no provision for adjustment to accommodate bags of different sizes. In addition, they are relatively large and bulky, and require a significant amount of storage space.

U.S. Pat. No. 5,588,622 (Gordon) describes a bag support system with a locking mechanism to keep the bag secured to the top of the support.

U.S. Pat. No. 5,570,872 (Nugent) shows a semi-rigid metal rod system for supporting lawn bags in which metal rods may be attached and detached from each other to allow for accommodation and securing of bags, with overlapping rods securing bags within the structure. The ends of certain rods may be inserted into the ground to provide stability to the system.

In spite of the numerous designs and structure for such bagging systems, no one bagging system is believed to provide the optimal capability for leaf raking and improvements are desirable.

SUMMARY OF THE INVENTION

A bag securing system for use with a standard garbage-type can (e.g., 20 gallon or 30 gallon can) and a standard plastic garbage or leaf bag (e.g., 20 gallon, 30 gallon or 50 gallon bag) can provide a secure system for enabling the raking, shoveling or sweeping of material into the bag while the can lies essentially horizontally along the ground. A flexible funnel-forming sheet (preferably with a rigid leading edge) is inserted into a can, pressing a lining bag against the inner surface of the can, and optionally engaging the can with a gripping system that engages the exterior of the can. A separate component of the system comprises an element engaged with the can (either attached to or separate from the funnel-forming sheet) that can secure the can to soft ground, as with spikes.

DETAILED DESCRIPTION OF THE INVENTION

A bag securing system is described for use with a standard or non-standard garbage-type can (e.g., 20 gallon or 30 gallon can) and a standard or non-standard plastic garbage or leaf bag (e.g., 20 gallon, 30 gallon or 50 gallon bag). The system can provide a secure support and enclosure for enabling the raking, shoveling or sweeping of material into the bag. The bag and system may be used while the can lies essentially horizontally along the ground. A flexible funnel-forming sheet (preferably with a rigid leading edge) is inserted into a can with a bag already lining the interior of the can or at least engaged over the entire opening of the can. The funnel-forming sheet presses a lining bag against the inner surface of the can and the sheet optionally engages the can with a gripping system that secures the funnel-forming sheet against the exterior of the can. A separate component of the system may comprise an element engaged with the can (either attached to or separate from the funnel-forming sheet) that can secure the can to soft ground, as with spikes.

The receptacle, box or can itself may be any trash can or other receptacle to which the funneling system is designed for fit and/or adjustable, and may be formed of any structural materials such as metal, composite, plastic or combinations of these materials. The bag may be any commercial bag or specially manufactured bag which has an opening sufficient to at least fill (even with stretching of the material) the can opening or better yet, extend across and overlap the can opening. The bag is inserted into the can (and preferably over the entire lip of the can) and the funnel-forming sheet is inserted into the can and shaped into a funnel of the appropriate size and dimensions, which is why the funnel-forming sheet is flexible and has other design features that allow for shaping and contouring of the funnel. The flexible funnel-forming sheet may be formed of polymeric material, elastomeric material, rubber, fabric, and the like, and as elsewhere described, may have other functional elements (slides, glides, hooks, eyes, and the like) attached thereto, which other functional elements may be made of other materials.

A brief view of the Figures may assist in a better appreciation of the technology described herein.

Figure 1:
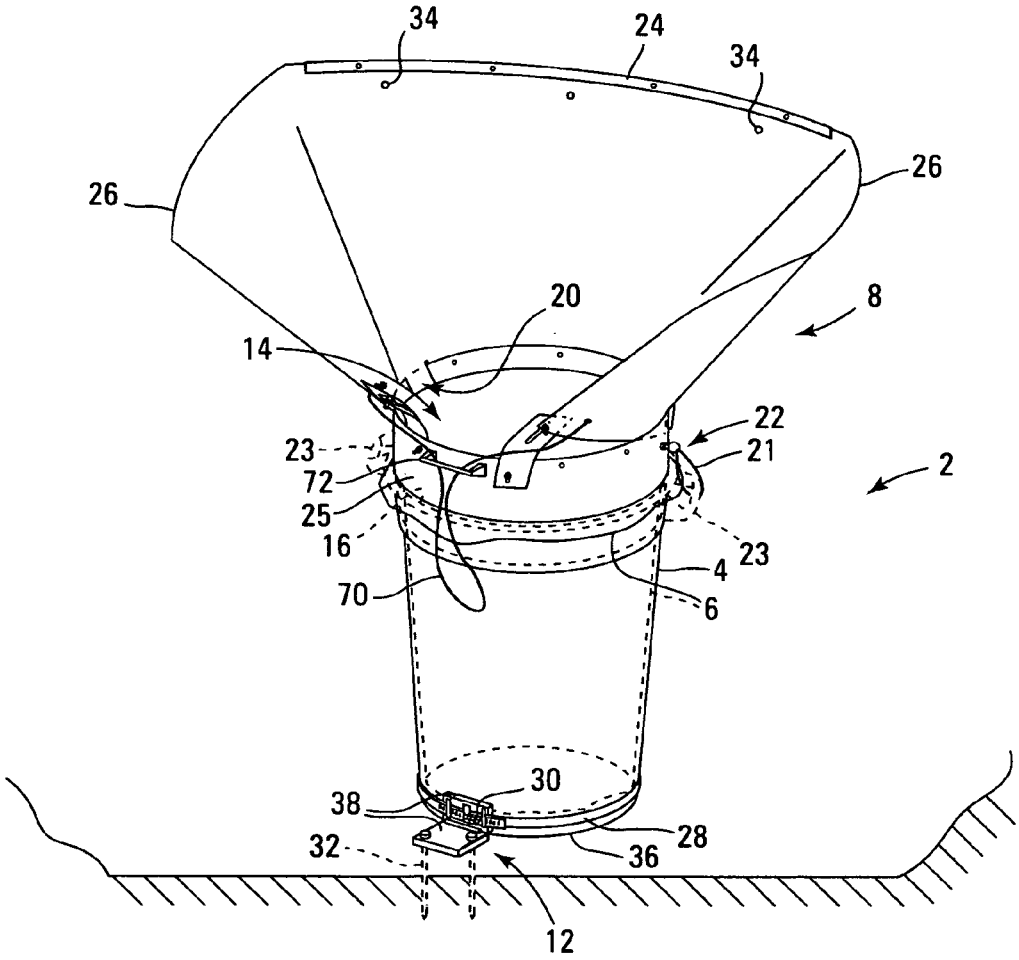
FIG. 1 shows a side view of a garbage can, bag, funnel-forming system with locking element, and a separate can-to-ground securing element.

FIG. 1 shows a side view of a material retaining system 2 comprising a garbage can 4, bag 6, funnel-forming system 8 with locking element 22, and a separate can-to-ground securing element 12. The bag 6 is shown with its opening end 14 extending over the lip 16 of the can 4. The FIG. 1 exaggerates certain of the elements and dimensions for ease of understanding. For example, the size and construction of the locking element 22 (comprising the pin element 22, elastic cord 21 may attach to a standard can handle or other protruding element 23. The funnel body 20 or neck element 25 presses the bag 6 against the interior of the can 4. The locking mechanism 10 does not need to have the swiveling or snapping component 22 that is shown. For example, the locking element 22 may be only a single clip, inserted post, clamp or the like (not shown) attached to the funnel body 20, as with a standard money-clip The system may further comprise the funnel-forming top section 26 with a rigidizing lip portion 24 that can assist in flattening the funnel against a surface. The rigidizing element 24 may be semi-rigid (as with a stiff elastomer or thin foldable metal (tin, aluminum, etc.) or rigid. There are holes 34 on the funnel-forming top section 26 that assist in engaging the top section 26 to turf (e.g., using pegs through the holes 34). An improved method of securing the entire system 2 plus the can 4 to turf or other surface that may be engaged is with the ground or surface engaging component 12. This surface engaging component 12 is shown somewhat askew and on the opposite side where it would ordinarily be deployed (e.g., on the same side of the can 4 as the flat rigidizing strip 24) for convenience in describing all of the elements. The surface engaging component has a strap 28 securing the component 12 to the can 4 bottom 36. There is a pivoting set of flat or otherwise shaped panels 38 which contain or to which may be attached pegs 32 (which may also be bolts or screws or other mechanical attachment devices). The surface engaging system may be secured to the work surface, and the entire system 2 placed against the ground while the posts 32 remain secured to the ground. When force is applied to the can 4 by way of contact or pressure developed during raking or the like, the component 12 will prevent shifting of can and allow greater raking or shoveling force to be applied during work.

Figure 2:
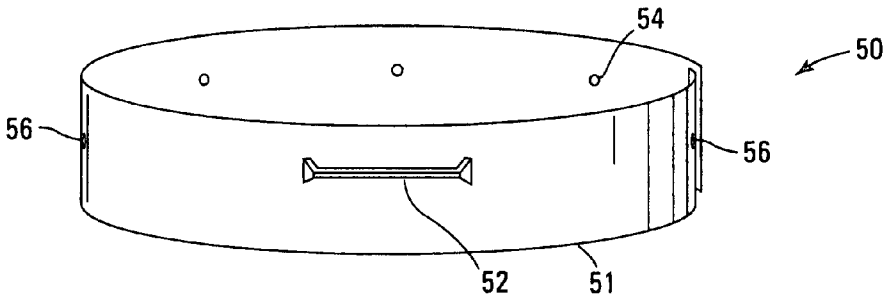
FIG. 2 shows a neck that is part of a funnel-forming system with can adjusting design incorporated therein.
Figure 3:
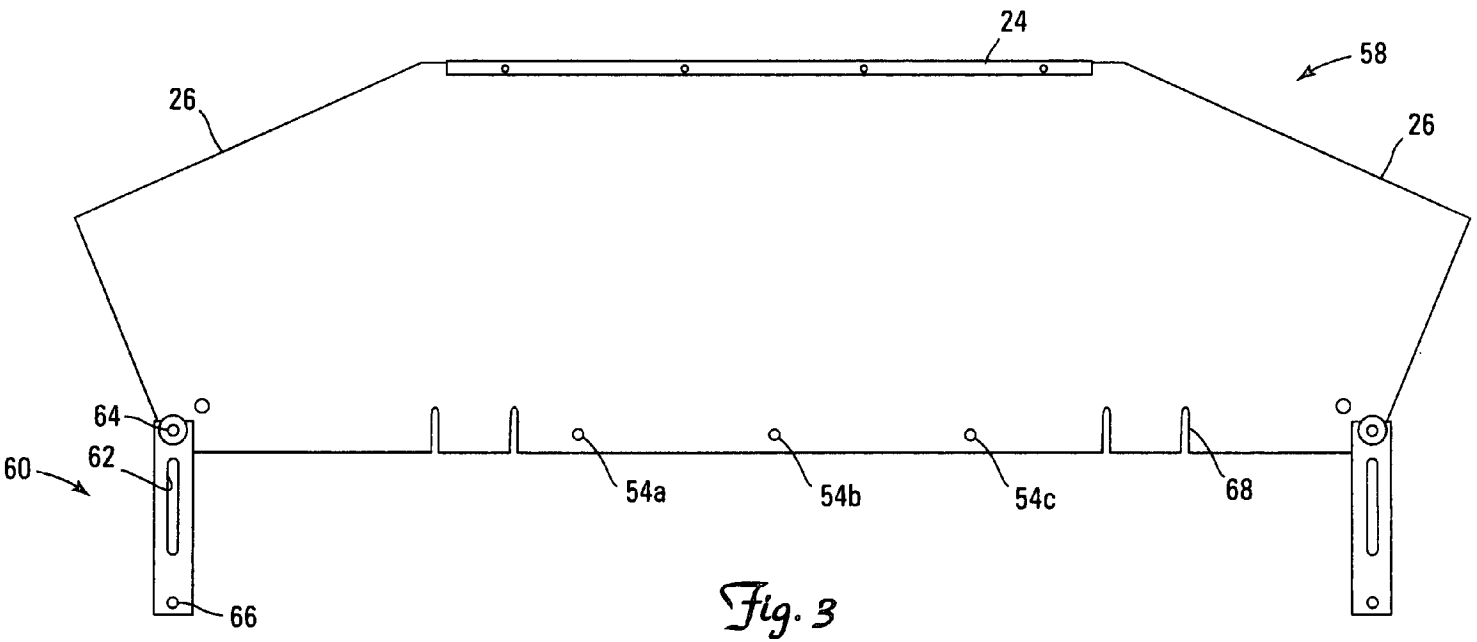
FIG. 3 shows an unfolded funnel-forming system for association with the neck of FIG. 2.

FIG. 2 shows a neck 50 that is part of a funnel-forming system with can adjusting design incorporated therein. The neck 50 is shown with a gripping handle 52, holes for assisting in engagement with corresponding holes 54*a* of a funnel forming system 58 (FIG. 3). Holes 56 are shown for assisting attachment of the locking mechanism (e.g., pins) described in FIG. 1.

FIG. 3 shows an unfolded funnel-forming system 58 for association with the neck of FIG. 2. The rigidizing strip 24 is shown, as are the countering holes 54*a* which align with holes 54 from FIG. 2 to assist in securing the neck to the funnel-forming element with pins, string, clips or other mechanical fasteners engaging both holes 54 54*a*. An adjusting or adjustable connecting element 60 allows the neck to better fit and adjust to the neck and can, with hole 66 engaging one stabilizing fixture (pin, handle, protrusion, post, etc.) while the swivel connection 64 allows adjustment of size and shape of the components being brought together. Similarly, an attaching pin or element (not shown) may pass through slide hole 62 to assist in the shape and size adjustment of components being fitted together. Open slots 68 are shown to assist in fitting the funnel-forming system to the neck of the can.

An alternative structure, again using the same figures, with certain additional, alternative elements not specifically shown, would be as a FIG. 1 side view of a material retaining system 2 comprising a garbage can 4, bag 6, funnel-forming system 8 with locking element 22 (here shown as a pin, but which might be a clamp, clip, snap, or other mechanical locking or securing device), and a separate can-to-ground securing element 12. The bag 6 is shown with its opening end 14 extending over the lip 16 of the can 4. The FIG. 1 exaggerates certain of the elements and dimensions for ease of understanding. The locking mechanism 22 does not need to have the swiveling or snapping components. For example, the locking element may be only a single clip (not shown) attached to the funnel body 20, as with a standard money-clip type format, made of a single living hinge, with the ends of the clip held against each other by the tension in the living hinge (not shown).

The funnel forming system 8 may be constructed of a single element or a combination of elements held together by mechanical connectors (fusion, adhesion, pins, bolts, clips, ties, staples, snaps, punches or combinations of these. The sides 26 of the system remain flexible so that they can fold over and adjust to the various size of the openings in whatever cans 4 are used to support the bag 6. It is desirable that a reinforcing or rigidizing element 24 is on the front of the system 8, to assure a flat or straight edge to lie on the ground to assist in preventing swept or raked material from passing under the leading edge of the system where the rigidizing element 24 is placed.

A ground securing element 12 is shown that may comprising any can engaging element 28 that secures to the can 4. In the embodiment shown in FIG. 1, the element 28 is shown as a strap (e.g., elastic strap) 28 having a clipping or tension-adjusting connector 30 that provides tension of the strap 28 against the can 4. Two prongs or stakes 32 are provided on the straps 28 which may be positioned to be on the same side of the can 4 as the can 4 as the rigidizing element 24 so that when the can 4 is lying against the ground, the prongs 32 can be pressed into the ground to resist any pressure from raking or sweeping causing the can 4 to slide along the ground. The strap 28 and prongs 32 are shown at an end of the can 4 distal from the opening and the lip 16 of the can 4, but the strap 28 and prongs 32 or other ground securing element may be at any designed or selected position along the height of the can 4 and may be provided with other structural designs. For example, the prongs may be directly attached to the system 8, as by having the prongs directly attached to a face of the system 8 that lies against the ground. The prongs may be on their own rigid support, or the prongs may be stakes (not shown) that are inserted through holes 34 in the system 8.

The bag 6, when filled, may be removed from the can 4 in various ways, the simplest way being described below. When the bag 6 is filled, the can 4 is lifted or swiveled from the ground if attached through system 12 from the ground (removing the prongs 32 from the ground and not removing the prongs, respectively) so that it stands vertically on its base 36. The locking mechanism 22 is disengaged or its tension reduced (e.g., by manually lifting an exterior element gripping the ends of the bag 6 at the opening 14 of the can 4. The system 8 is then lifted from the can 4, often by sliding the system 8 from the can 4. This leaves the bag 6 with its ends extended over the lip 16 of the can 4. The bag ends may be lifted from the lip 16 and tied. Because the bag 6 and can 4 had been lying horizontally, the pressure of the fill within the bag 6, such as the leaves against the interior of the can 4 should not have been great enough to cause dramatic difficulty in removing the bag 6. The prongs may be supported in a way so that they are not exposed at all times in a way that could injure someone carrying the system. For example, the prongs could fold, could be supported on a folding support, or could be extendable and snap into place. In one embodiment, two panels (e.g. about 30 cm×10 cm) could be connected by a hinge, and the prongs could be carried on a surface of the relatively exterior of the panels when it swings outward on the hinge.

FIG. 3 shows a funnel-forming system 58 with can adjusting design incorporated therein. The system 58 is shown constructed of a neck portion 50 (FIG. 2) that fits into a can (not shown). The lower edge 51 of the neck portion 50 is shown as slightly larger than other portions (e.g., higher, more forward portion) so that the lower edge 51 can provide some tension against a bag inside of a can. The size of the circumference of the lower edge 51 may be adjustable, even to dimensions smaller that those of the more forward portions of the neck portion 50, as by clips, pins or other connectors represented in FIG. 2 by holes 54 and a clip (not shown) passing through one of the holes 54. The circumference of the lower edge 51 can be seen to be adjustable by repositioning the clip in a different hole 54 to cause the circumference of the lower edge 51 to change. The neck portion 50 has a funnel portion 58 attached or associated therewith. The funnel portion 58 may be an integral part (cut from the same sheet material) as the neck portion 50 or may be secured to the neck portion 50 by chemical or mechanical means, such as adhesive, fusion, clips, staples, pins, bolts, ties, snaps, and the like. The funnel portion 58 has flexible ends 26 than may be flexed or folded or shaped to assist in adjusting to any available can size. Further adjustment to different can sizes or ground contour can be effected by an adjustment system (e.g., 60) that allows the flexible ends 26 to be positioned and secured to the neck portion 50 easily. One simple mechanism is a panel 60 having an elongated hole 62 therein along which hole 62 a pin, screw or other extending element (not shown) may slide (and preferably be adjustable and capable of being tightened to grip the panel 60. The extending element is attached to or attachable to the flexible ends 26. The panels 60 are secured to the neck portion 50 by connectors 64 that may allow the panels to swivel to further assist in the ease of the funnel portion 58 adjusting to the size of the available can.

The flexible ends 26 may have holes **54*a* therein, with a pull string 70 (FIG. 1) passing through the holes 54*a* and engaged (e.g., as by a knot, not shown) on the reverse side of the neck 50 and possibly through a handle 72 on the neck of extending through the neck from the can 4. The string 70 may pass through a support loop of handle 72 on which loop 72 the pull string 70 may be pulled and/or attached to secure the flexible ends 26** in a desirable position.

The funnel-providing system 58 may be further supported, guided or positioned against a can by used of a can engaging or securing system(s) 60. The can engaging system 60 may be a simple flexible, semi-rigid or rigid element that it attached to the neck portion 50 or funnel portion 58 and slides over the lip of the can (not shown) to provide tension against the outside of the can or against the lip of the can to support the funnel-providing system 58 and/or grip ends of a contained bag to secure the bag against slipping. Securing elements may be provided (not shown), and these may be adjustable to control tension or the length of overlap of the can engaging system 21 and 22 (FIG. 1) with a can 4.

The system may be alternatively described as follows. It is a system that provides a shaped access path to a bag within a receptacle comprising a funnel-providing system comprising a neck portion and a funnel portion. The funnel-providing portion comprises a flexible material that forms a leading edge of the funnel portion that curves back onto itself to form a funnel having a wide leading edge and a narrower base of the funnel portion. The narrower base of the funnel portion is connected to the neck portion. A gripping element extends over at least a length of the neck portion, the gripping portion capable of gripping an element, such as a garbage bag or plastic bag placed between the gripping element and the neck portion. The leading edge of the funnel-providing portion may be rigidized to form a straight edge that is not significantly curved when the funnel is shaped, so that a flat leading edge lies along ground when the system is lying on the ground. The neck portion is adjustable to provide different stable circumferences (not necessarily rigid circumferences, but at least approximate circumferences that flex, which can provide tension against bags on interior surfaces of the cans) of the neck portion for insertion into receptacles of varying sizes. The neck portion is thus adjustable to provide different levels of tension against inside surfaces of the receptacle. The system may comprise at least one extension that can be inserted into ground to secure the system against movement. The at least one extension (preferably at least two extensions or stakes or pegs) may comprise stakes attached to the system or stakes that can be affixed to the receptacle separately from the system. The system may be secured to a receptacle comprising a can with at least a 1 cubic meter volume, the can having a garbage bag, such as polymeric, paper or composite bag within the volume of the can and ends of the bag extending over edges of the opening of the can, the gripping elements gripping the ends of the bag to prevent slippage of the bag within the can. When the system is lying horizontally along ground, the at least one extension penetrates the ground to restrict movement of the can when force is applied to the system.

The system has been most focused on raking or sweeping into the funnel system. Attempting to power blow material would tend to require a larger funnel. This can be effected either by making the initial funnels system wider and longer, or by inserting a separate second funnel element into the first funnel system.

Although specific materials, dimensions, sizes and components have been described herein, these descriptions are not intended to limit the scope of practice of the technology described herein, but rather constitute specific examples supporting generic concepts. Even where specific structural elements or materials are described, it is understood by those skilled in the art that other equivalents and interchangeable materials and shapes may be used.

What is claimed is:

1. A system for providing a shaped access path to a bag within a receptacle comprising:

a funnel-providing system comprising a neck portion and a funnel portion;

the funnel-providing portion comprising a flexible material that forms a leading edge of the funnel portion that curves back onto itself to form a funnel having a wide leading edge and a narrower base of the funnel portion;

the narrower base of the funnel portion connected to the neck portion having stings attached at edges of the narrower base to enable the edges to be shaped towards each other;

a gripping element that extends over at least a length of the neck portion, the gripping portion capable of gripping an element placed between the gripping element and the neck portion.

2. The system of claim 1 wherein the leading edge of the funnel-providing portion forms a straight edge that is not curved when the funnel is shaped.

3. The system of claim 1 wherein the neck portion is adjustable to provide different stable circumferences of the neck portion for insertion into receptacles of varying sizes.

4. The system of claim 3 wherein the neck portion is adjustable to provide different levels of tension against inside surfaces of the receptacle.

5. The system of claim 1 further comprising at least one extension that can be inserted into round to secure the system against movement.

6. The system of claim 1 secured to a receptacle comprising a can with at least a 1 cubic meter volume, the can having a polymeric bag within the volume of the can and ends of the bag extending over edges of the opening of the can, the gripping elements gripping the ends of the bag to prevent slippage of the bag within the can.

7. The system of claim 2 secured to a receptacle comprising can with at least a 1 cubic meter volume, the can having a polymeric bag within the volume of the can and ends of the bag extending over edges of the opening of the can, the gripping elements gripping the ends of the bag to prevent slippage of the bag within the can.

8. The system of claim 3 secured to a receptacle comprising a can with at least a 1 cubic meter volume, the can having a polymeric bag within the volume of the can and ends of the bag extending over edges of the opening of the can, the gripping elements gripping the ends of the bag to prevent slippage of the bag within the can.

9. The system of claim 4 secured to a receptacle comprising a can with at least a 1 cubic meter volume, the can having a polymeric bag within the volume of the can and ends of the bag extending over edges of the opening of the can, the gripping elements gripping the ends of the bag to prevent slippage of the bag within the can.

10. The system of claim 5 secured to a receptacle comprising a can with at least a 1 cubic meter volume, the can having a polymeric bag within the volume of the can and ends of the bag extending over edges of the opening of the can, the gripping elements gripping the ends of the bag to prevent slippage of the bag within the can.

11. The system of claim 1 wherein the string passes through holes or handles on the edges to allow pulling on the string to shape the funnel portion.

12. The system of claim 10 lying horizontally along ground, with the at least one extension penetrating the ground to restrict movement of the can when force is applied to the system.

13. The system of claim 11 secured to a receptacle comprising a can with at least a 1 cubic meter volume, the can having a polymeric bag within the volume of the can and ends of the bag extending over edges of the opening of the can, the gripping elements gripping the ends of the bag to prevent slippage of the bag within the can.

14. The system of claim 13 further comprising at least one extension that can be inserted into ground to secure the system against movement.

15. A system for providing a shaped access path to a bag within a receptacle comprising:

a funnel-providing system comprising a neck portion and a funnel portion;

the funnel-providing portion comprising a flexible material that forms a leading edge of the funnel portion that curves back onto itself to form a funnel having a wide leading edge and a narrower base of the funnel portion;

the narrower base of the funnel portion connected to the neck portion;

a gripping element that extends over at least a length of the neck portion, the gripping portion capable of gripping an element placed between the gripping element and the neck portion, further comprising at least one extension that can be inserted into ground to secure the system against movement wherein the at least one extension comprises stakes attached to the system.

16. The system of claim 15 secured to a receptacle comprising a can with at least a 1 cubic meter volume, the can having a polymeric bag within the volume of the can and ends of the bag extending over edges of the opening of the can, the gripping elements gripping the ends of the bag to prevent slippage of the bag within the can.

17. The system of claim 16 lying horizontally along ground, with the at least one extension penetrating the ground to restrict movement of the can when force is applied to the system.

18. A system for providing a shaped access path to a bag within a receptacle comprising:

a funnel-providing system comprising a neck portion and a funnel portion;

the funnel-providing portion comprising a flexible material that forms a leading edge of the funnel portion that curves back onto itself to form a funnel having a wide leading edge and a narrower base of the funnel portion;

the narrower base of the funnel portion connected to the neck portion;

a gripping element that extends over at least a length of the neck portion, the gripping portion capable of gripping an element placed between the gripping element and the neck portion, further comprising at least one extension that can be inserted into ground to secure the system against movement wherein the at least one extension comprises stakes that can be affixed to the receptacle separately from the system.

19. The system of claim 18 secured to a receptacle comprising a can with at least a 1 cubic meter volume, the can having a polymeric bag within the volume of the can and ends of the bag extending over edges of the opening of the can, the gripping elements gripping the ends of the bag to prevent slippage of the bag within the can.

20. The system of claim 19 lying horizontally along ground, with the at least one extension penetrating the ground to restrict movement of the can when force is applied to the system.

* * * * *